US011988045B2

(12) United States Patent
Teodorescu et al.

(10) Patent No.: US 11,988,045 B2
(45) **Date of Patent: *May 21, 2024**

(54) ECCENTRIC REAMING TOOL

(71) Applicant: Stabil Drill Specialties, L.L.C., Lafayette, LA (US)

(72) Inventors: Sorin Gabriel Teodorescu, Houston, TX (US); Donnie Williams, Houston, TX (US); Lot William Short, Jr., Dallas, TX (US); Robert B. Beggs, Rowlett, TX (US); Richard E. Beggs, Rowlett, TX (US)

(73) Assignee: Stabil Drill Specialties, L.L.C., Lafayette, LA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/062,851

(22) Filed: Dec. 7, 2022

(65) Prior Publication Data

US 2023/0094335 A1 Mar. 30, 2023

Related U.S. Application Data

(63) Continuation of application No. 16/256,690, filed on Jan. 24, 2019, now Pat. No. 11,603,709.

(60) Provisional application No. 62/621,276, filed on Jan. 24, 2018.

(51) Int. Cl.

| | |
|---|---|
| ***E21B 10/26*** | (2006.01) |
| ***E21B 7/28*** | (2006.01) |
| ***E21B 10/43*** | (2006.01) |

(52) U.S. Cl.

CPC ..... *E21B 10/26* (2013.01); *E21B 7/28* (2013.01); *E21B 10/43* (2013.01)

(58) Field of Classification Search

CPC ..... E21B 10/26; E21B 7/28; E21B 10/43

See application file for complete search history.

(56) References Cited

U.S. PATENT DOCUMENTS

| | | | |
|---|---|---|---|
| 4,385,669 | A | 5/1983 | Knutsen |
| 4,989,681 | A | 2/1991 | Lohmiiller et al. |
| 5,415,243 | A | 5/1995 | Lyon et al. |
| 5,544,713 | A | 8/1996 | Dennis |
| 7,207,402 | B2 | 4/2007 | Bjork |
| 9,328,565 | B1 | 5/2016 | Cannon |
| 2002/0125047 | A1 | 9/2002 | Beaton |
| 2002/0166703 | A1 | 11/2002 | Presley et al. |

(Continued)

OTHER PUBLICATIONS

PCT Application No. US2019/014965, International Search Report and Written Opinion of the International Searching Authority for Applicant Stabil Drill Specialties, LLC dated Jun. 4, 2019.

(Continued)

*Primary Examiner* — Robert E Fuller
*Assistant Examiner* — Neel Girish Patel
(74) *Attorney, Agent, or Firm* — Jones Walker LLP

(57) ABSTRACT

A reaming tool for use in a wellbore has an elongated tubular body with an outer surface. There are at least first and second reamer sections formed on the tubular body, with the first and second reamer sections (i) being positioned circumferentially opposite one another, and (ii) each having at least two blades. The first reamer section includes at least one rounded dome insert and a majority of cutting tooth inserts, while the second reamer section includes a majority of rounded dome inserts.

12 Claims, 4 Drawing Sheets

(56) References Cited

U.S. PATENT DOCUMENTS

| | | | | |
|---|---|---|---|---|
| 2004/0134687 | A1 | 7/2004 | Radford et al. | |
| 2005/0252694 | A1 | 11/2005 | Kennedy et al. | |
| 2010/0051349 | A1* | 3/2010 | Ballard | E21B 10/26 175/57 |
| 2010/0096189 | A1* | 4/2010 | Salzer, III | E21B 17/1078 175/92 |
| 2011/0127044 | A1 | 6/2011 | Radford et al. | |
| 2012/0043087 | A1* | 2/2012 | Torres | E21B 10/602 166/311 |
| 2012/0255786 | A1* | 10/2012 | Isenhour | E21B 10/26 175/57 |
| 2013/0306380 | A1* | 11/2013 | Oesterberg | B23P 15/46 175/263 |
| 2014/0345952 | A1* | 11/2014 | Short, Jr. | E21B 10/42 175/406 |
| 2015/0083497 | A1* | 3/2015 | Mageren | E21B 10/60 175/57 |
| 2016/0265280 | A1* | 9/2016 | Shotwell | E21B 10/44 |
| 2017/0198527 | A1* | 7/2017 | Delwiche | E21B 10/56 |
| 2017/0234092 | A1* | 8/2017 | Howard | E21B 29/00 166/376 |
| 2019/0055787 | A1* | 2/2019 | Trunk | E21B 10/325 |
| 2019/0292857 | A1* | 9/2019 | Short, Jr. | E21B 10/26 |

OTHER PUBLICATIONS

PCT Application No. US2019/014965, International Preliminary Report on Patentability for Applicant Stabil Drill Specialties, LLC dated Jul. 28, 2020.

Scoles, Stanley R. "Boronizing as a Substitute for Cobalt Bearing Alloys," NBSIR 82-2495 Conservation and Substitution Technology for Critical Materials, vol. 1, Proceedings of Public Workshop by U.S. Dept. of Commerce/National Bureau of Standards/U.S. Dept. of the Interior and U.S. Dept. of Mines, Jun. 15-17, 1981.

"DOG-drilling on guage sub" retrieved from https://www.slb.com/drilling/bottomhole-assemblies/reamers-and-stabilizers/dog-drilling-on-gauge-sub on Aug. 31, 2020; 2 pages.

"Reamer" retrieved from https://www.paradigm.eu/drilling/products/revolution/reamer on Aug. 31, 2020; 2 pages.

"Diamond-Enhanced Insert Stabilizer" retrieved from https://www.slb.com/drilling/bottomhole-assemblies/reamers-and-stabilizers/diamond-enhanced-stabilizer on Aug. 31, 2020; 1 page.

* cited by examiner

ECCENTRIC REAMING TOOL

CROSS REFERENCE TO RELATED APPLICATIONS

This application is a continuation of U.S. Non-Provisional application Ser. No. 16/256,690, filed Jan. 24, 2019, which claims the benefit under 35 USC § 119(e) of U.S. Provisional Application No. 62/621,276, filed Jan. 24, 2018, both of which are incorporated by reference in their entirety.

FIELD OF THE INVENTION

The present invention relates in general to reamer devices used in conjunction with the drilling of boreholes, particularly boreholes for oil and gas exploration and production.

BACKGROUND OF THE INVENTION

In drilling a boreholes for the recovery of hydrocarbons (e.g., crude oil and/or natural gas) from a subsurface formation, it is conventional practice to connect a drill bit onto the lower end of an assembly of drill pipe sections connected end-to-end (commonly referred to as a "drill string"), and then rotate the drill string so that the drill bit progresses downward into the earth to create the desired borehole. A typical drill string also incorporates a "bottom hole assembly" ("BHA") disposed between the bottom of the drill pipe sections and the drill bit. The BHA is typically made up of sub-components such as drill collars and special drilling tools and accessories, selected to suit the particular requirements of the well being drilled.

Often the BHA incorporates a reaming tool (or "reamer"). Reaming may be required to enlarge the drift diameter of a borehole that was drilled with a motor or RSS (rotary steerable system) assembly making a borehole having a high tortuosity. By using a reamer, the drift diameter is improved allowing the casing operation to become more efficient. Alternatively, reaming may be needed in order to maintain a desired diameter (or "gauge") of a borehole drilled into clays or other geologic formations that are susceptible to plastic flow (which will induce radially-inward pressure tending to reduce the borehole diameter). Reaming may also be required for boreholes drilled into non-plastic formations containing fractures, faults, or bedding seams where instabilities may arise due to slips at these fractures, faults or bedding seams.

DETAILED DESCRIPTION OF SELECTED EMBODIMENTS

Figure 1:
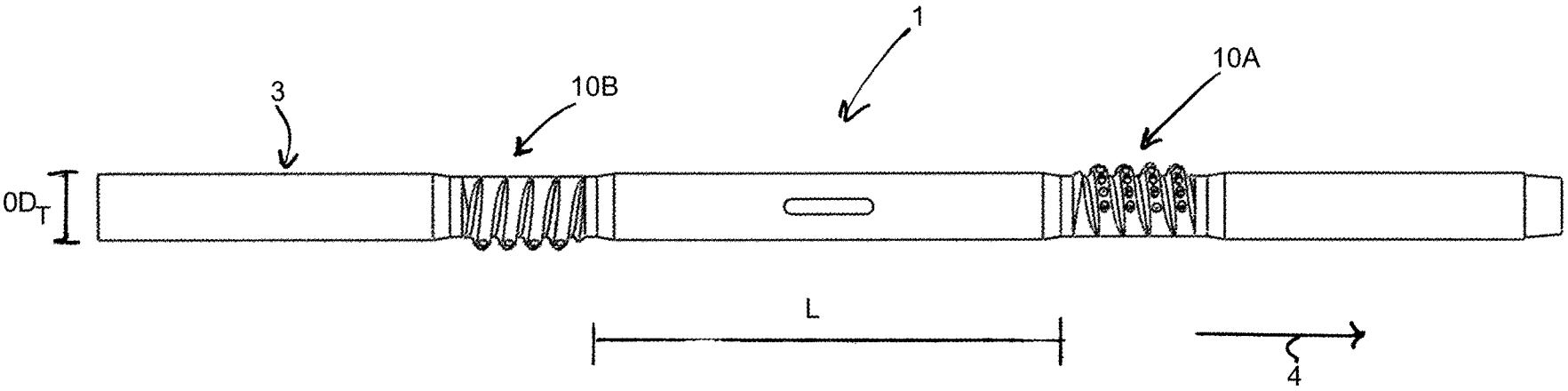
FIG. 1 illustrates one embodiment of the reaming tool of the present invention.

FIG. 1 shows one embodiment of the reaming tool 1 of the present invention. Most generally, reaming tool 1 is constructed from a tubular body 3 having multiple reamer sections 10 (reamer sections 10A and 10B in FIG. 1) formed on the tubular body. In certain embodiments, the reamer section 10B may perform more of a stabilizing function than a cutting function and therefore, is sometimes referred to herein as "stabilizing section" 10B. In many embodiments, tubular body 3 is a conventional steel tubular as typically used in the drilling industry and having standard sized outer diameters ($OD_T$) ranging from 4.75" to 22", but in particular cases OD tubulars outside this range could be employed. FIG. 1 illustrates reaming tool 1 oriented with the downhole direction 4 being to the right in the figure. Additionally, the reamer section 10B is positioned circumferentially opposite reamer section 10A, i.e., reamer section 10B is 180° (or approximately 180°, e.g., 160° to 200°) circumferentially offset from reamer section 10A in order to dynamically balance centrifugal forces generated by the rotating reamers. Typically, the longitudinal distance (i.e., the distance along the length of tubular body 3) "L" between the center of the two reamer sections 10A and 10B will be between 2 feet and 6 feet (or any subrange in between).

Figure 2:
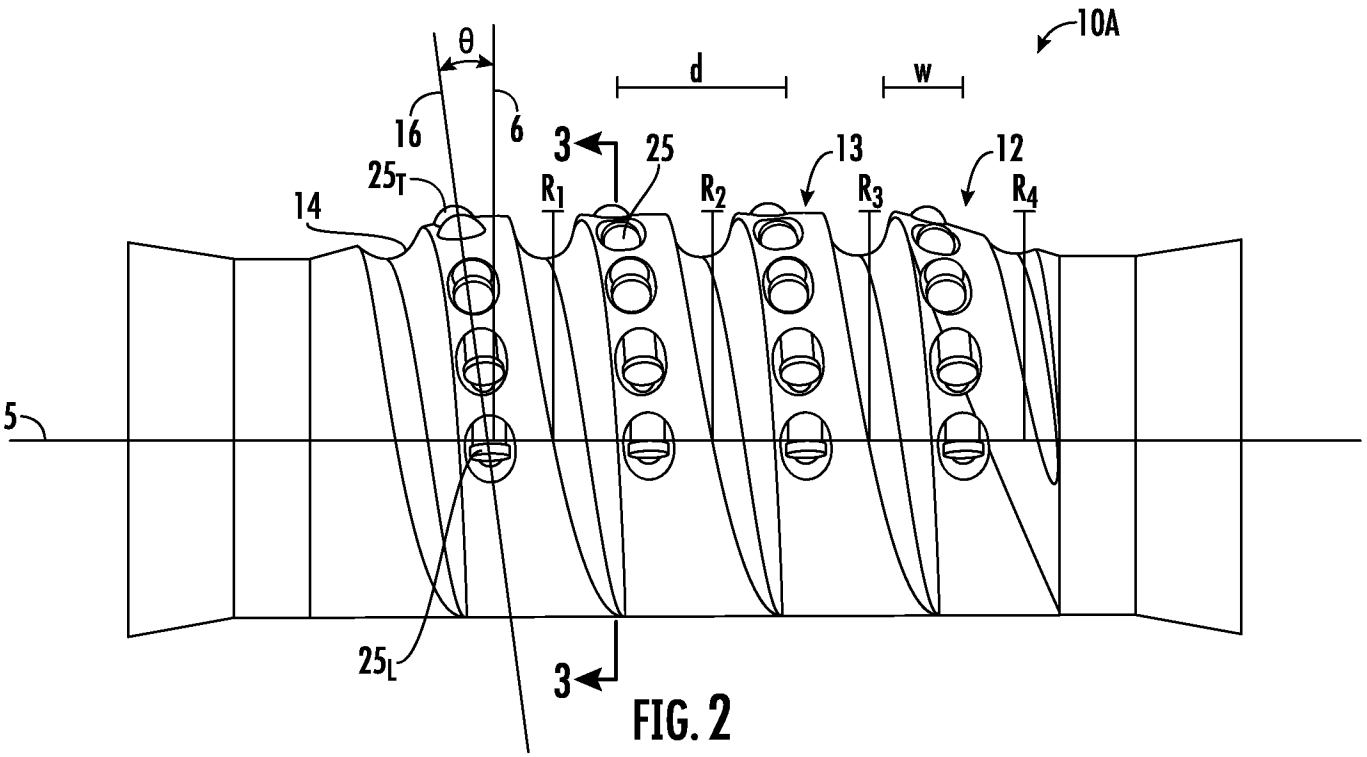
FIG. 2 illustrates an enlarged view of a reamer section seen in FIG. 1.

FIG. 2 presents a more detailed view of the reamer section 10A. In this embodiment, the reamer section 10A includes four blades 12 which are formed on tubular body 3 by milling channels 14 into the outer surface of tubular body 3. Naturally, the blades 12 could be formed on the tubular body by other means as long as the blade are sufficiently attached to withstand the stresses of the reaming operations. Likewise, the reamer section could have fewer (e.g., 2 or 3) or more (e.g., 5 to 20) blades than the four shown. Typically, the blades will have a width "w" across the top of the blade surface ranging between about 1 inch and about 3 inches. The distance "d" between the center of one blade and the center of an adjacent blade will range between about 1 inch and about 6 inches.

Figure 3:
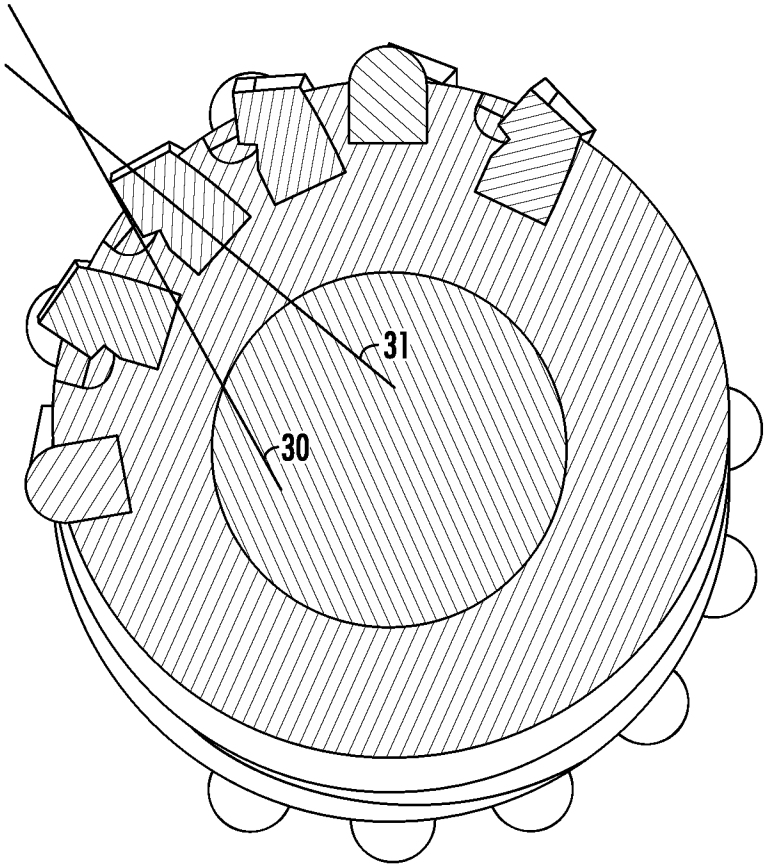
FIG. 3 illustrates a cross-sectional view of a reamer section of FIG. 2.
Figure 5B:
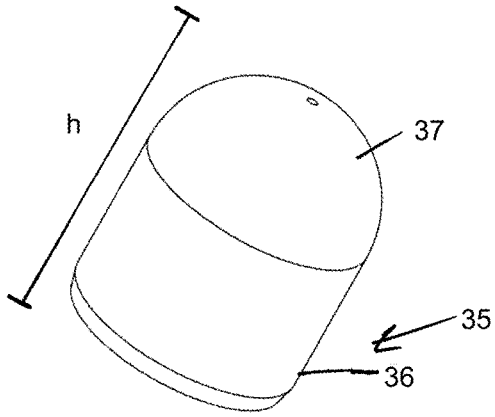
FIGS. 5A and 5B illustrate alternative insert designs.
Figure 5A:
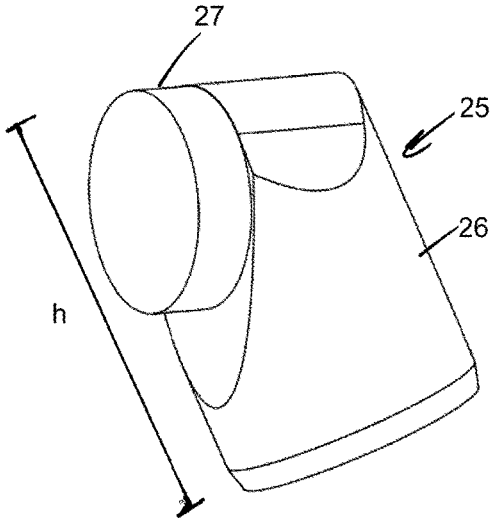

In FIG. 2, the blades 12 are shown with a series of cutting tooth inserts 25 positioned along the blade top surface 13. FIG. 5A suggests how one example of cutting tooth inserts 25 includes cylindrical base 26 with a cutting surface or edge surface 27 formed on cylindrical base 26. Although the diameter of cylindrical base 26 could vary in different embodiments, two preferred embodiments of the inserts will have a cylindrical diameter of 13 mm (0.524") and 19 mm (0.75"). In one embodiment, edge surface 27 is a disc shaped cap of a very hard substance, such as a tungsten carbide or diamond material. In embodiments not having a specific cap, the edge surface 27 may be formed where the flat surface (face) meets the circumference of the disc. FIG. 3 illustrates a line 30 parallel to the face of edge surface 27 and a line 31 which passes through the cylindrical base 26 in a radial direction. The angle between the line 30 (the cutter surface) and line 31 is often referred to as the "back-rake" angle. Most generally, the back-rake angle will range anywhere between about 5° and about 40°. The lower angle orients the cutting surface in a more aggressive cutting posture, which for example, is more likely to be used in comparatively hard formations.

Returning to FIG. 2, it can be seen that blades 12 include a series of insert pockets 24 into which the cutting tooth inserts 25 are fixed by brazing or other conventional means. Normally, any number between 3 and 15 cutting tooth inserts 25 are fixed on each blade 12. The blades 12 are also oriented at a pitch angle relative to the perpendicular axis 6 of the reaming tool. The perpendicular axis 6 is a line running perpendicular to the reaming tool's longitudinal or centerline axis 5 extending along the center point of the tubular body's central passage. FIG. 2 also shows a pitch line 16 which extends from the center of the trailing cutting tooth insert $\mathbf{25}_T$ to the leading cutting tooth insert $\mathbf{25}_L$ on each blade. The pitch angle theta is the angle between the tool perpendicular axis 6 and the pitch line 16. Likewise, the pitch line 16 is oriented such the leading cutting tooth insert $\mathbf{25}_L$ is positioned closer to the drill bit than the trailing cutting tooth insert $\mathbf{25}_T$. In many embodiments, the pitch angle theta will be less than about 30°, and in preferred embodiments, between about 5° and about 15°. Where the formation material is considered comparatively hard, e.g., having an unconfined compressive strength (UCS) of around 20-25 kpsi, the pitch angle will be shallower (i.e., a lower numerical value). Where the formation material is considered comparatively soft, e.g., a UCS of around 8-10 kpsi, the pitch angle will be steeper (i.e., a higher value). Likewise, the back-rake angle of the cutting tooth inserts will be shallower in hard formations (i.e., less of the edge surface 27 extending above the pocket 24's edge) and steeper in softer formations.

The height (or radii) of the blade surfaces 13 from the tool centerline 5 are designated R1, R2, R3, and R4 in FIG. 2. In different embodiments, these radii may be all the same, may be all different, or may be some combination of these two options. In one preferred embodiment, R1 is equal to the outer radius of the tool body 3 (i.e., one-half the tool body's OD); R2 is 1/16" less than R1; R3 is equal to R1; and R4 is equal to R2. The 1/16" shorter radius of R2 is generally the case for tool bodies with ODs of less than 12.25". For tool bodies with ODs of over 12.25", R2 would more typically be 1/8" less than R1.

Figure 4A:
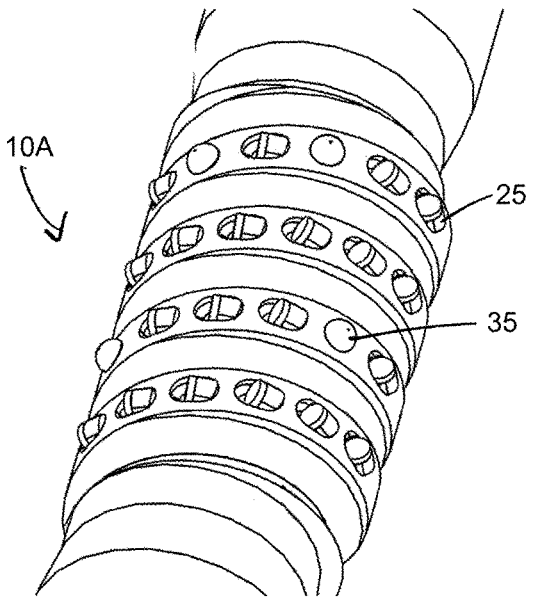
FIGS. 4A and 4B illustrate alternative insert configurations for the reamer sections.
Figure 4B:
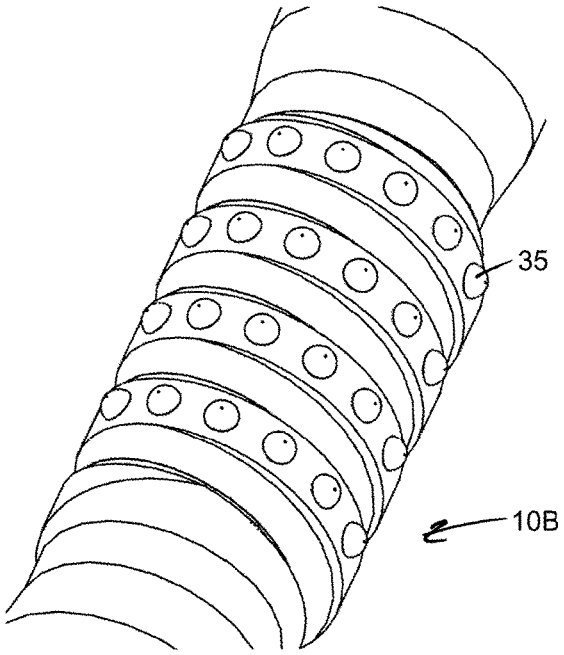

While the FIG. 2 embodiment shows each pocket 24 as including a cutting tooth insert 25, FIGS. 4A to 4C illustrate an alternate insert being used in combination with cutting tooth insert 25. Rounded dome inserts 35 as seen in FIG. 5B include a cylindrical insert base 36 and a rounded top surface 37. In the FIG. 5B embodiment, the rounded top surface 37 is a hemisphere, but could take on other rounded surfaces which are not perfectly hemispherical, e.g., ellipsoidal, slightly conical, etc. It is only necessary for rounded top surface 37 to not have abrupt surface changes which form edge surfaces which results in a cutting effect. As with the cutting tooth inserts 25, two preferred embodiments of the dome shaped inserts will have cylindrical diameters of 13 mm or 19 mm. In many embodiments, the top (i.e., outermost radial distance from centerline axis 5) of the dome of inserts 35 will be the same height as the uppermost tip of the cutting tooth inserts 25. In many applications, the cutting tooth inserts 25 and rounded dome inserts 35 will be positioned within the insert pockets such that between about 20% and 50% of their height "h" extends out of the insert pocket. It will be understood that both the back-rack angle and the percentage of the insert extending beyond the pocket are "control parameters" which may be used to control how aggressively the cutting tooth inserts remove material from the formation.

In certain embodiments, it is desirable to reduce the magnitude of cutter insert-to-formation exposure experienced during a reaming operation. This may be accomplished by replacing a given number of cutting tooth inserts 25 with rounded dome inserts 35. The rounded dome inserts 35 can be mixed in any different number of combinations with the cutting tooth inserts 25. In particular, it may be advantageous to have a majority (i.e., at least 51%) of cutting tooth inserts on the lead reamer section (i.e., reamer section 10A in FIG. 1) and a majority of rounded dome inserts on the trailing reamer section (i.e., reamer section 10B in FIG. 1). In this example, trailing reamer section 10B may be considered a "stabilizing section." FIG. 4A shows an example of lead reamer section 10A which has two rounded dome inserts 35 on the first and third blades, with the remaining inserts being cutting tooth inserts 25. Thus, no more than 4 of 24 (or about 17%) of the inserts or are rounded dome in this embodiment of the lead reamer section 10A, leaving about 83% of the inserts being the cutting tooth type. In other embodiments of the lead reamer section 10A, this percentage of rounded dome inserts could be no more than 30% of the total inserts in the lead reamer section. Typically, the rounded dome inserts will be distributed on alternating (i.e., not adjacent) blades, but this need not always be the case. FIG. 4B shows an example of a trailing reamer section 10B where all (100%) of the inserts are rounded dome inserts 35. However, in other embodiments, this percentage could be at least 70%, 80%, or 90% of the inserts in the trailing reamer section being of the rounded dome type.

In alternative embodiments not illustrated, a reamer section might include one or two blades having exclusively dome inserts 35 and the other blades having only cutting tooth blades 25. Conceivably, an embodiment could include a single dome shaped insert 35 on a single blade. The number of dome shaped inserts as a percentage of the total inserts on all blades of a reamer section can range between about 10% and about 90% (or any sub-range there between).

In the lead reamer section, the top of the rounded dome inserts (i.e., the uppermost surface of the insert in a radial direction extending from the center of the tool) are slightly more elevated than the corresponding surface on the cutting tooth inserts, for example, the uppermost surface of the round dome inserts being 5% to 20% higher above the edge of the pocket than that of the cutting tooth inserts. In this manner, the use of a small number of dome inserts in the lead reamer section provides protection of the cutter tooth inserts while running through a casing section or performing other sliding operations. In the case of the trailing balancing section, the top of the rounded dome inserts will generally be at the same height as the top of the cutting tooth inserts in the lead reamer section.

Furthermore, for harder formations, the cutting efficiency of the lead reamer section may be increased by using a higher number of cutting tooth inserts in each blade. For example, FIG. 4A shows six cutting tooth inserts on the blades not having rounded dome inserts. More generally, the blades of the lead reamer section could have anywhere between 2 and 10 inserts per blade. In the same fashion, the blade width can be increased to accommodate 2 cutter inserts and may have back-up cutters, one or multiple rows behind.

Although the invention has been described in terms of certain specific embodiments, those skilled in the art will understand there can be many modifications and variations. For example, while FIG. 2 shows two reamer sections 10, other embodiments could have more reamer sections, typically an even number 180° offset in order to keep the reaming tool balanced. Likewise, it will be understood that many factors affect the rotational speed at which the reaming tool will most efficiently operate, for example, formation hardness, blade pitch, and back-rake angle. In certain embodiments, this rotational speed will be between about 60 and about 240 revolutions per minute, or any sub-range there between, such as about 180 and about 200. As one example, where the reaming tool is used in harder formations, the percentage of inserts being rounded dome shaped inserts 35 may be between about 10% and 20% of the total, while the reaming tool is operated at an RPM range of about 180 to 200. Similarly, where the formation is softer, the percentage of inserts being rounded dome shaped inserts 35 may be between about 80% and 90%, while the reaming tool is operated at an RPM range of about 50 to 80.

Terms used herein shall be given their customary meaning as understood by those skilled in the art, unless those terms are given a specific meaning in this specification. The term "about" will typically mean a numerical value which is approximate and whose small variation would not significantly affect the practice of the disclosed embodiments. Where a numerical limitation is used, unless indicated otherwise by the context, "about" means the numerical value can vary by +/−5%, +/−10%, or in certain embodiments+/−15%, or even possibly as much as +/−20%.

The invention claimed is:

1. A reaming tool for use in a wellbore, the reaming tool comprising:

(a) an elongated tubular body with an outer surface;

(b) at least a reamer section and a stabilizer section formed on the tubular body, the reamer section and the stabilizer section (i) being positioned circumferentially opposite one another, and (ii) each having at least two blades, wherein the blades have a pitch angle with respect to an axis perpendicular to a longitudinal axis of the tubular body of 5° to 15°;

(c) the reamer section including at least one rounded dome insert configured not to have a cutting effect and a majority of cutting tooth inserts, wherein (i) a number of rounded dome inserts in the reamer section as a percentage of total inserts in the reamer section is less than 30%, and (ii) an uppermost surface of the at least one rounded dome insert in the reamer section is elevated at least as high as an uppermost surface of the cutting tooth inserts in the reamer section to protect the cutting tooth inserts;

(d) the stabilizer section including only exclusively rounded dome inserts configured not to have a cutting effect and no cutting tooth inserts, wherein the rounded dome inserts have no abrupt surface changes or edges;

(e) wherein the total inserts are positioned on the blades of the reamer section, such that the total inserts extend along less than 50% of an entire circumference of the outer surface of the tubular body; and (f) wherein the total inserts are positioned on the blades of the stabilizer section such that the total inserts extend along less than 50% of the entire circumference of the outer surface of the tubular body.

2. The reaming tool of claim 1, wherein a top of the rounded dome inserts configured not to have a cutting effect in the stabilizer section are at a height no greater than a top of the cutting tooth inserts in the reamer section.

3. The reaming tool of claim 1, wherein the blades of the reamer section have a top surface having a width twice a diameter of the cutting tooth inserts.

4. The reaming tool of claim 1, wherein the blades are arranged in a spiral orientation in a direction causing a lead cutting tooth insert on each blade in the reamer section, given a direction of reaming tool rotation, to be positioned further in a downhole direction than the other cutting tooth and rounded dome inserts on the respective blade.

5. A method of performing reaming operations within a wellbore formed through a formation having an unconfined compressive strength over 10 ksi, the method comprising the steps of:

(a) positioning a drill string in the wellbore, the drill string including a drill bit and a reaming tool, the reaming tool comprising:

(i) an elongated tubular body with an outer surface;

(ii) at least a reamer section and a stabilizer section formed on the tubular body, the reamer section and the stabilizer section (1) being positioned circumferentially opposite one another, and (2) each having at least two blades, wherein the blades have a pitch angle with respect to an axis perpendicular to a longitudinal axis of the tubular body of 5° to 15°;

(iii) the reamer section including at least one rounded dome insert configured not to have a cutting effect and a majority of cutting tooth inserts, wherein (i) a number of rounded dome inserts in the reamer section as a percentage of total inserts in the reamer section is less than 30%, and (ii) an uppermost surface of the at least one rounded dome insert in the reamer section is elevated at least as high as an uppermost surface of the cutter cutting tooth inserts in the reamer section to protect the cutting tooth inserts;

(iv) the stabilizer section including only rounded dome inserts configured not to have a cutting effect and no cutting tooth inserts, wherein the rounded dome inserts have no abrupt surface changes or edges;

(v) wherein the total inserts are positioned on the blades of the reamer section, such that the total inserts extend along less than 50% of an entire circumference of the outer surface of the tubular body; and (vi) wherein the total inserts are positioned on the blades of the stabilizer section such that the total inserts extend along less than 50% of the entire circumference of the outer surface of the tubular body; and (b) operating the reaming tool in the wellbore at between 60 and 100 revolutions per minute (RPM).

6. The method of claim 5, wherein the blades of the reamer section have a top surface having a width twice a diameter of the cutting tooth inserts.

7. The method of claim 5, wherein the blades are arranged in a spiral orientation in a direction causing a lead cutting tooth insert on each blade in the first reamer section, given a direction of reaming tool rotation, to be positioned further in a downhole direction than the other cutting tooth and rounded dome inserts on the respective blade.

8. The method of claim 5, wherein a top of the rounded dome inserts configured not to have a cutting effect in the stabilizer section are at a height no greater than a top of the cutting tooth inserts in the reamer section.

9. A reaming tool for use in a wellbore, the reaming tool comprising:

(a) an elongated tubular body with an outer surface;

(b) at least a reamer section and a stabilizer section formed on the tubular body, the reamer section and the stabilizer section (i) being positioned circumferentially opposite one another, and (ii) each having at least two blades, wherein the blades have a pitch angle with respect to an axis perpendicular to a longitudinal axis of the tubular body of 5° to 15°;

(c) the reamer section including at least one rounded dome insert configured not to have a cutting effect and a majority of cutting tooth inserts, wherein (i) a number of rounded dome inserts in the reamer section as a percentage of total inserts in the reamer section is less than 30%, and (ii) an uppermost surface of the at least one rounded dome insert in the reamer section is elevated at least as high as an uppermost surface of the cutting tooth inserts in the reamer section to protect the cutting tooth inserts;

(d) the stabilizer section including only exclusively rounded dome inserts configured not to have a cutting effect and no cutting tooth inserts, wherein the rounded dome inserts have no abrupt surface changes or edges;

(e) wherein the total inserts are positioned on the blades of the reamer section, such that the total inserts extend along less than half of an entire circumference of the outer surface of the tubular body; and (f) wherein the total inserts are positioned on the blades of the stabilizer section such that the total inserts extend along less than half of the entire circumference of the outer surface of the tubular body.

10. The reaming tool of claim 9, wherein a top of the rounded dome inserts configured not to have a cutting effect in the stabilizer section are at a height no greater than a top of the cutting tooth inserts in the reamer section.

11. The reaming tool of claim 9, wherein the blades of the reamer section have a top surface having a width twice a diameter of the cutting tooth inserts.

12. The reaming tool of claim 9, wherein the blades are arranged in a spiral orientation in a direction causing a lead cutting tooth insert on each blade in the reamer section, given a direction of reaming tool rotation, to be positioned further in a downhole direction than the other cutting tooth and rounded dome inserts on the respective blade.

* * * * *